US005730590A

United States Patent [19]

Maury

[11] Patent Number: 5,730,590

[45] Date of Patent: Mar. 24, 1998

[54] INLET FOR FEEDING RAW MATERIALS INTO A ROTARY DRUM

[76] Inventor: Hans-Dietmar Maury, Hindemithstrasse 5, D-59227 Ahlen, Germany

[21] Appl. No.: 448,551

[22] PCT Filed: Oct. 10, 1994

[86] PCT No.: PCT/EP94/03332

§ 371 Date: Jun. 9, 1995

§ 102(e) Date: Jun. 9, 1995

[87] PCT Pub. No.: WO95/10745

PCT Pub. Date: Apr. 20, 1995

[30] Foreign Application Priority Data

Oct. 9, 1993 [DE] Germany ..... 43 34 521.2

[51] Int. Cl.[6] ..... F27B 7/00

[52] U.S. Cl. ..... 432/103

[58] Field of Search ..... 432/103, 106, 432/115, 116

[56] References Cited

U.S. PATENT DOCUMENTS

| | | | |
|---|---|---|---|
| 2,266,396 | 12/1941 | Lincoln et al. | 432/116 |
| 3,436,061 | 4/1969 | Zinn | 432/106 |
| 3,547,417 | 12/1970 | Elkjaer . | |
| 4,508,503 | 4/1985 | Ramesohl | 432/106 |
| 5,123,496 | 6/1992 | Ahvenainen | 432/103 |

FOREIGN PATENT DOCUMENTS

| | | |
|---|---|---|
| 0606918 | 7/1994 | European Pat. Off. . |
| 1195119 | 11/1959 | France . |
| 2634545 | 1/1990 | France . |
| 66492 | 3/1968 | Germany . |
| 2940727 | 4/1981 | Germany . |
| 3245702 | 7/1984 | Germany . |
| 589523 | 1/1978 | U.S.S.R. . |
| 2131931 | 6/1984 | United Kingdom . |

*Primary Examiner*—Raymond A. Nelli
*Attorney, Agent, or Firm*—Robert W. Becker & Associates

[57] ABSTRACT

An inlet for introducing raw material into a rotary drum has a chute made of a metal mantle and an inner lining of refractory material. The chute has a forward end for connecting it to the rotary drum. A hollow collar is detachably connected to the forward end of the chute so as to extend into the rotary drum. The collar is closed toward the rotary drum. The collar has surfaces facing the rotary drum. The surfaces have a heatproof, ceramic protective lining against abrasion. The collar has a back side facing the forward end of the chute. The back side has a projection for connecting the collar to the chute.

4 Claims, 3 Drawing Sheets

INLET FOR FEEDING RAW MATERIALS INTO A ROTARY DRUM

BACKGROUND OF THE INVENTION

The invention relates to an inlet for feeding raw material into a rotary drum, particularly into a cylindrical rotary kiln for the production of cement clinkers, the rotary drum provided with a chute that leads to an inlet opening of the rotary drum. The chute consists of a metal mantle and an interior lining of refractory material, with the part of the chute located at the very front being formed by a collar that extends into the rotary drum. The collar is removably attached to the chute and designed to be hollow and closed toward the rotary drum.

Inlets of cylindrical rotary kilns with inlet chutes for the material are, for example, known from U.S. Pat. No. 3,547,417. The chutes utilized with such units are subject to a very high abrasive and thermal stress which is associated with a progressive abrasion of the refractory lining, particularly in the area of the outlet end of the chute.

In order to prevent the disadvantages, associated therewith it is known from DE-32 45 702 C2 to provide at the end of the chute a collar for supporting the refractory lining which collar is double-walled and consists of separate supporting segments and is facing the rotary drum. By individual stays the collar is divided into chambers which are open toward the exterior of the chute and can be cooled by introducing a cooling medium from the exterior.

However, this inlet is also subject to high abrasive forces so that maintenance work is often required during its service life.

The object of the invention is to develop the known inlet for feeding raw materials into a rotary drum such that greater repair intervals during service life and greater ease of service are achieved.

SUMMARY OF THE INVENTION

For resolving this object, it is suggested that the collar is provided with a refractory abrasion protector of a ceramic material at the surfaces facing the rotary drum, and that the collar is provided at its back side with a projection by means of which the collar can be suspended on the chute or a part thereof.

An inlet for introducing raw material into a rotary drum according to the present invention is primarily characterized by:

- a chute comprising a metal mantle and an inner lining of refractory material, the chute having a forward end for connecting the chute to a rotary drum;
- a hollow collar detachably connected to the forward end of the chute so as to extend into the rotary drum, the collar being closed toward the rotary drum;
- the collar having surfaces facing the rotary drum, the surfaces having a heatproof, ceramic protective lining against abrasion; and
- the collar having a back side facing the forward end of the chute, the back side having a projection for connecting the collar to the chute.

Preferably, the projection extends perpendicular to a longitudinal axis of the collar.

Such an inlet shows a significantly reduced wear in the area of the collar so that it is less frequently required, compared with known constructions, to carry out repairs and maintenance work in the area of the inlet of the rotary drum. Moreover, it is particularly simple to attach the collar, respectively, to remove it again. Since it is simply suspended on the chute, it is not necessary to remove the refractory lining of the chute for replacing the collar, so that, altogether, a construction is achieved which makes repair and maintenance easier.

BRIEF DESCRIPTION OF THE DRAWINGS

Further details and advantages of the object of the invention follow from the subsequent description of the accompanying drawings. It is shown in.

DESCRIPTION OF PREFERRED EMBODIMENTS

Figure 1:
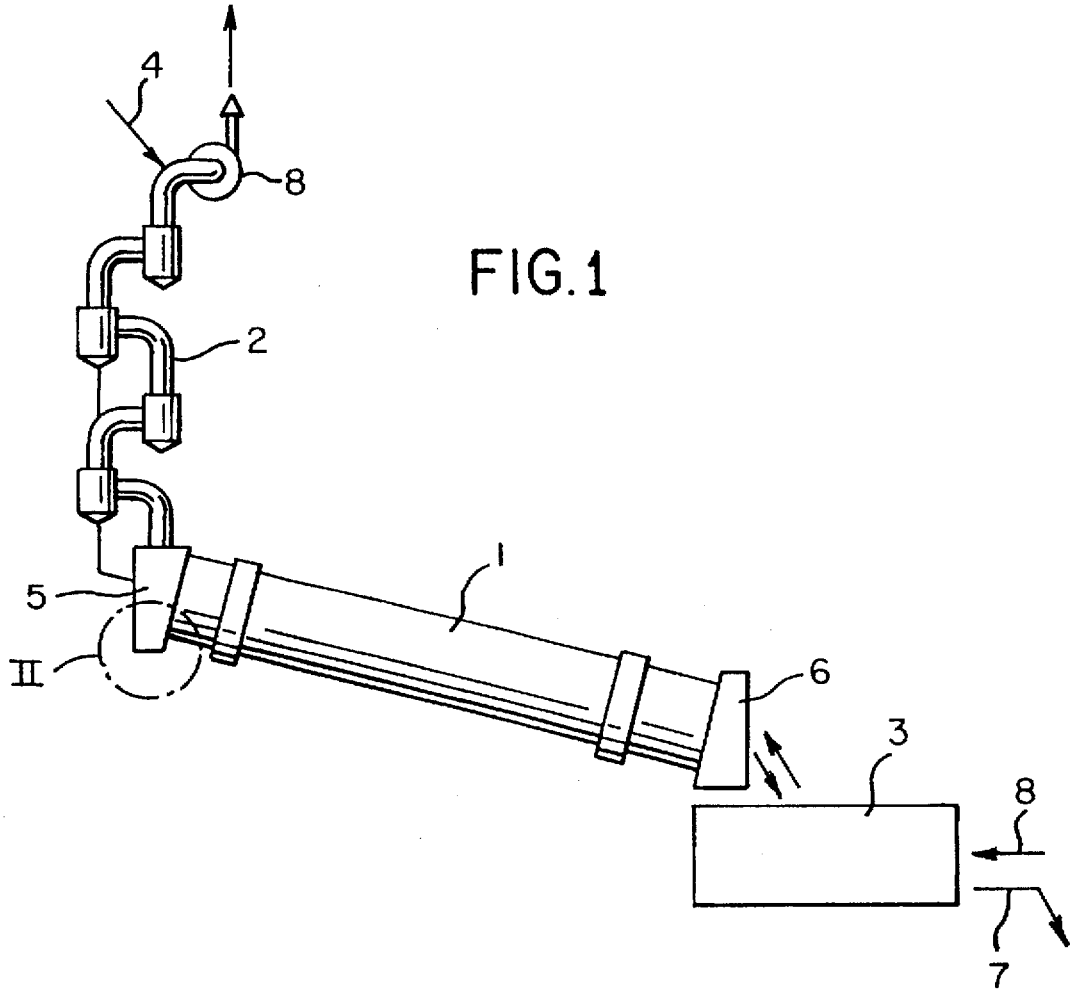
FIG. 1 a schematic of a unit for the production of cement clinkers.

FIG. 1 illustrates a unit for the production of cement clinkers. It comprises a cylindrical rotary kiln in which the cement clinker is fired, a preheating system 2 which is designed in the embodiment as a four-step cyclone heat exchanger unit, as well as a cooling device 3 downstream of the cylindrical rotary kiln 1.

The raw material enters the preheating system 2 at the location with the reference numeral 4, passes the individual steps one after another in order to reach the cylindrical rotary kiln 1 subsequently via a kiln inlet housing. The preheating system 2 is provided with a firing so that the raw material that is fed into the cylindrical rotary kiln 1 is not only preheated but already partly calcined. The raw material which has been completely calcined and sintered in the cylindrical rotary kiln 1, leaves it through the outlet 6 and is subjected to further processing, for example, grinding of the clinker, after passing the cooling device 3 in the direction of the arrow 7. At the same time, air flows through the cooling device 3, the cylindrical rotary kiln 1, and the preheating system 2 in the direction of the arrow 8 in counter flow relative to the raw materials to be processed, and finally is removed with the help of a blower.

Figure 2:
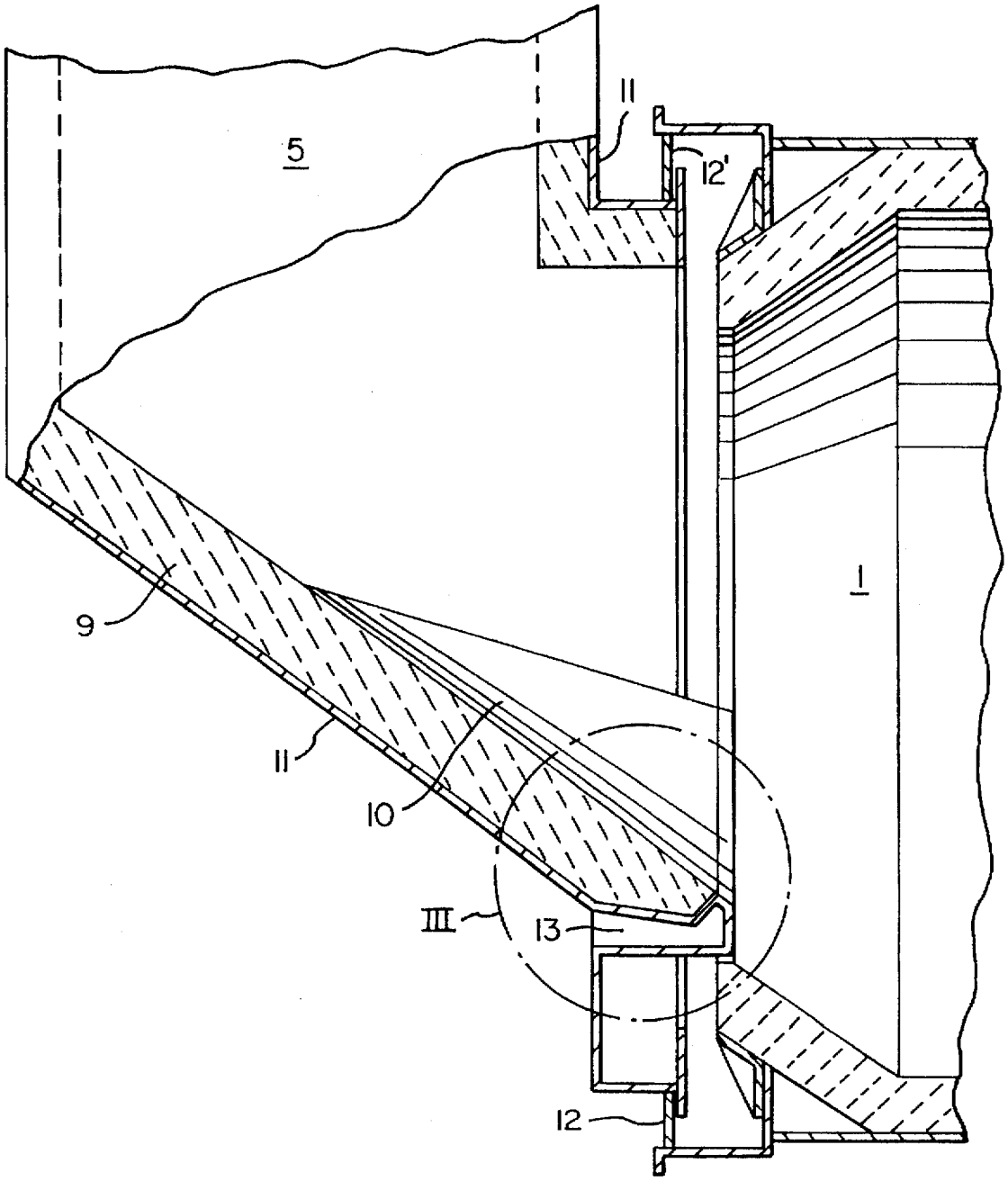
FIG. 2 PRIOR ART
FIG. 2 a section of FIG. 1 in the area of the inlet to a cylindrical rotary kiln, and FIG. 3 details of a collar arranged in the area of the inlet.

The raw material leaving the preheating system 2 and reaching the furnace inlet housing 5 has considerable temperatures, especially when a partial calcining occurs in the area of the preheating system 2 so that the lining 9 of refractory material, illustrated in FIG. 2, which is part of a chute 10 of the kiln inlet housing 5 is subjected to a high thermal, mechanical, and particularly abrasive stress.

The chute 10 is formed by a metal mantle 11 in the shape of a conical surface. The refractory lining 9 is provided on the inner side of the metal mantle 11.

The sealings 12, 12' create a gas-tight connection between the rotating cylindrical rotary kiln 1 and the stationary kiln inlet housing 5.

A double-walled, hollow collar 13, positioned inwardly and approximately horizontally, forms the lower closure of the metal mantle toward the furnace, and thus of the chute 10. This collar 13 secures the lining 9 in this area and is attached to the chute 10, respectively to the metal mantle 11 of the chute 10 in a manner described in detail in the following.

Since the collar 13 is formed to be hollow, cooling air can be guided into the interior of the collar 13 via pipes not illustrated here. This cooling air cools the interior wall of the collar 13 and thus contributes to the reduction of the otherwise very high temperatures.

Figure 3:
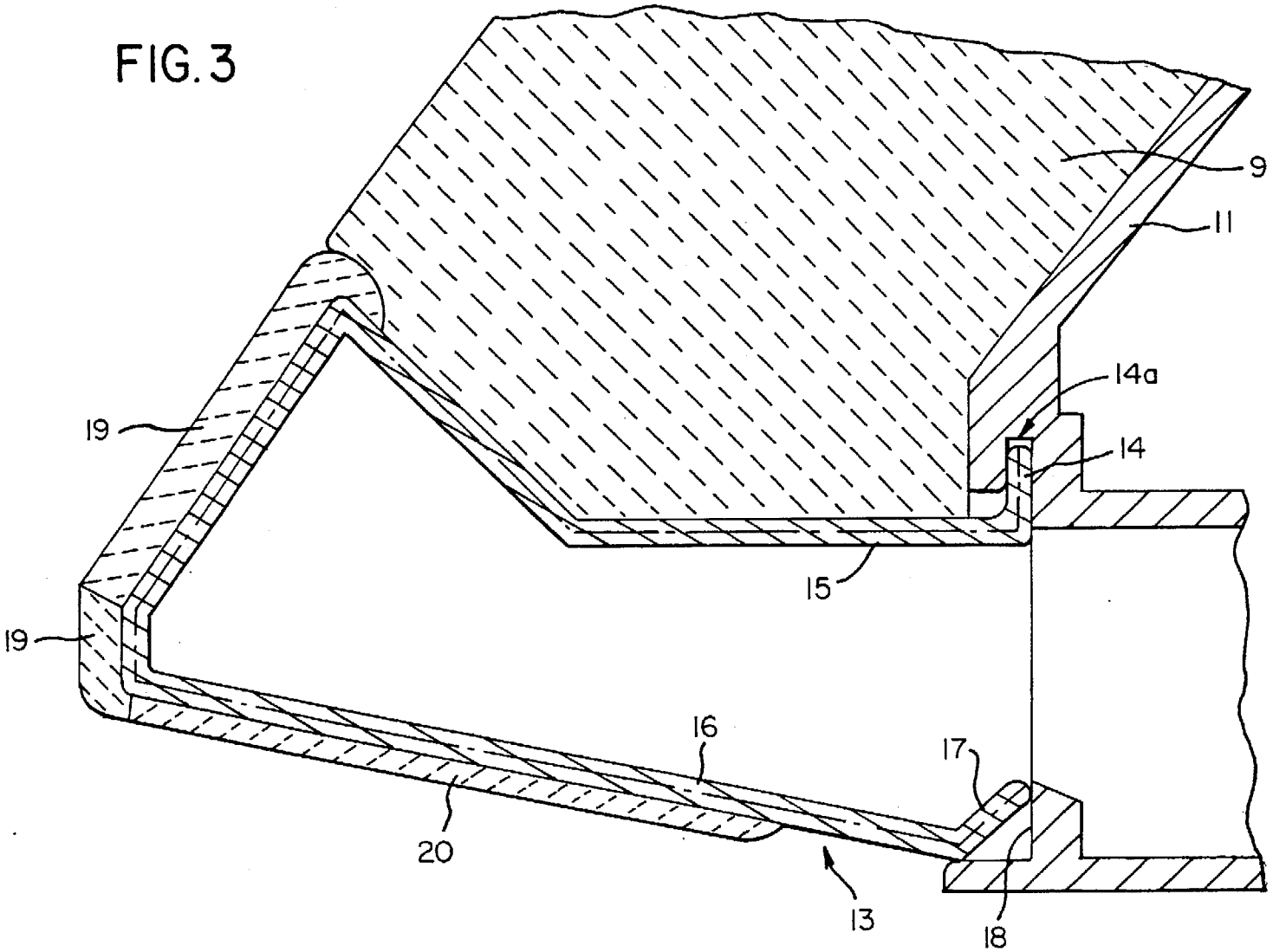

Details of the collar are illustrated in FIG. 3. It is designed as a double-walled construction in which the thus formed hollow interior which is provided with cooling air inlets, is closed off toward the drum type furnace 1, and is open in the opposite direction, i.e. at the back side of the collar 13, for letting in the cooling air. The back side of the collar 13 is provided with a projection 14 which extends vertically, relative to the longitudinal axis of the collar 13, and by means of which the collar 13 can be suspended from a receiving opening 14*a* of the metal mantle 11 of the chute 10. The projection 14 is formed as a rear angular portion of the upper wall 15 of the collar 13. Opposite the projection 14, the lower wall 16 of the collar 13 is provided with an obliquely upwardly extending angular portion 17. When the collar 13 is suspended on the chute 10, this angular portion 17 abuts a supporting surface 18 of the inlet housing 5. By this design of the projection 14 as well as of the angular portion 17 it is ensured that the collar 13 can be removed and again suspended without having to remove the lining 9 of the chute 10 prior to this.

FIG. 3 illustrates that the collar 13 is provided with a lining 19 at its front side facing the drum type furnace 1. The lining 19 forms a heatproof abrasion protection and for this purpose consists of an appropriate ceramic material which is preferably screw-connected to the respective wall of the collar 13. In order to achieve a best-possible abrasion protection, each of the wear-sensitive surfaces of the collar 13 is provided with the lining 19. Since abrasive actions also occur in the area of the lower wall 16 of the collar 13, a part 20 of the lining also extends into this area.

The present invention is, of course, in no way restricted to the specific disclosure of the specification and drawings, but also encompasses any modifications within the scope of the appended claims.

What I claim is:

1. An inlet for introducing raw material into a rotary drum, said inlet comprising:

a chute comprising a metal mantle and an inner lining of refractory material, said chute having a forward end for connecting said chute to a rotary drum;

a hollow collar detachably connected to said forward end of said chute so as to extend into the rotary drum, said collar being closed toward the rotary drum;

said collar having surfaces facing the rotary drum, said surfaces having a heatproof, ceramic protective lining against abrasion;

said collar having a back side facing said forward end of said chute, said back side having a projection; and said forward end of said chute having a receiving opening for receiving said projection to thereby suspend said collar from said chute.

2. An inlet according to claim 1, wherein said projection extends perpendicular to a longitudinal axis of said collar.

3. An inlet according to claim 1, wherein said collar has an upper wall and wherein said projection is a rear angular portion of said upper wall.

4. An inlet according to claim 1, wherein said collar has a lower wall with an obliquely upwardly extending angular portion located opposite said projection and wherein said forward end of said chute has a supporting surface at which said obliquely upwardly extending angular portion rests.

* * * * *